US012687034B2

(12) United States Patent
Lawson

(10) Patent No.: US 12,687,034 B2
(45) Date of Patent: Jul. 21, 2026

(54) INFLATABLE SHELTER, KITS, METHODS, AND SYSTEMS

(71) Applicant: RISE Outdoor Innovation Inc., Whistler (CA)

(72) Inventor: Todd Lawson, Whistler (CA)

(73) Assignee: RISE Outdoor Innovation Inc., Whistler (CA)

( * ) Notice: Subject to any disclaimer, the term of this patent is extended or adjusted under 35 U.S.C. 154(b) by 469 days.

(21) Appl. No.: 18/073,818

(22) Filed: Dec. 2, 2022

(65) Prior Publication Data

US 2023/0212872 A1 Jul. 6, 2023

Related U.S. Application Data

(60) Provisional application No. 63/296,195, filed on Jan. 4, 2022.

(51) Int. Cl.
*E04H 15/20* (2006.01)
*E04H 15/56* (2006.01)

(52) U.S. Cl.
CPC ..... *E04H 15/20* (2013.01); *E04H 15/56* (2013.01); *E04H 2015/201* (2013.01); *E04H 2015/206* (2013.01); *E04H 2015/208* (2013.01)

(58) Field of Classification Search
CPC ... E04H 15/20; E04H 15/56; E04H 2015/201; E04H 2015/206; E04H 2015/208
USPC ..... 52/2.18
See application file for complete search history.

(56) References Cited

U.S. PATENT DOCUMENTS 2,656,844 A * 10/1953 Kreuzer ..... E04H 15/20 5/413 R
2,742,912 A * 4/1956 Blanchard ..... E04H 15/16 135/117
2,754,836 A * 7/1956 William ..... E04H 15/20 52/2.21

(Continued)

OTHER PUBLICATIONS https://serenelifehome.com/products/sltentair; Air Tent Integrated Airbed SLTENTAIR.
https://aesent.com.

*Primary Examiner* — James M Ference
(74) *Attorney, Agent, or Firm* — Kyle R Satterthwaite; Ryan W Dupuis; Ade & Company Inc

(57) ABSTRACT

An inflatable shelter features a built-in air mattress at a base thereof that defines a ground footprint of the shelter. An inflationally erectable canopy features inflatable ribs with wall panels interspersed therebetween. An interior tent space is delimited between the inflated base mattress and overlying canopy. Some of the ribs cantilever outwardly from the base when inflated, creating one or more inflationally erectable overhangs that expand the covered area of the shelter beyond the base footprint thereof. A shared on-board inflation device inflates both the mattress and rib structure, whose inflatable interiors are fluidly isolated to allow user setting or tuning of the mattress pressure independently of the rib structure's inflation level. A power supply of the inflation device includes electrical ports for connection of chargeable devices, lighting, and other accessories. Arching rib pars meet with a central lengthwise rib, providing structural integrity and a spaciously elongated tent space.

13 Claims, 5 Drawing Sheets

(56) References Cited

U.S. PATENT DOCUMENTS 2,782,794 A * 2/1957 White ..... E04H 15/20 52/2.19
2,854,014 A * 9/1958 Hasselquist ..... E04H 15/20 441/40
2,938,526 A * 5/1960 Harrison, III ..... E04H 15/20 D25/13
2,946,337 A * 7/1960 Wolshin ..... E04H 15/20 52/2.21
2,955,606 A * 10/1960 Walker ..... E04H 15/20 52/2.21
2,961,802 A * 11/1960 Mongan ..... E04H 15/20 D25/4
3,068,494 A * 12/1962 Pinkwater ..... A47C 27/081 5/708
3,170,472 A * 2/1965 Cushman ..... E04H 15/22 52/2.16
3,284,965 A * 11/1966 Michenfelder ..... E04H 15/003 D25/56
3,388,711 A * 6/1968 Huddle ..... E04H 15/04 D21/837
3,394,720 A * 7/1968 Moss ..... E04H 15/003 D21/837
3,457,684 A * 7/1969 Wood, Jr. ..... E04H 15/20 52/2.21
3,751,862 A * 8/1973 Linecker ..... E04H 15/20 52/80.1
3,840,919 A * 10/1974 Middleton ..... E04H 15/20 52/2.21
3,856,029 A * 12/1974 Huddle ..... E04B 7/14 135/132
3,970,096 A * 7/1976 Nicolai ..... E04H 15/14 135/117
4,072,158 A * 2/1978 O'Brien ..... E04H 15/00 135/117
4,165,757 A * 8/1979 Marks ..... E04H 15/32 135/93
4,192,030 A * 3/1980 Casson ..... A45F 3/00 4/538
4,197,681 A * 4/1980 Holcombe ..... E04C 3/005 52/2.21
4,269,210 A * 5/1981 Marks ..... E04H 15/32 403/292
4,271,642 A * 6/1981 Karr ..... E04H 15/20 52/2.21
D261,407 S * 10/1981 Moss ..... D21/837
4,408,260 A * 10/1983 Miedel ..... E04H 15/10 362/208
4,531,330 A * 7/1985 Phillips ..... E04H 15/20 52/DIG. 13
4,605,029 A * 8/1986 Russell ..... E04H 15/324 5/413 R
4,607,655 A * 8/1986 Wagner ..... E04H 15/20 5/629
4,719,934 A * 1/1988 Mydans ..... E04H 15/40 135/121
4,766,918 A * 8/1988 Odekirk ..... E04H 15/30 441/38
4,876,829 A * 10/1989 Mattick ..... E04H 15/20 135/125
D305,681 S * 1/1990 Moss ..... D21/838
4,928,442 A * 5/1990 Kroetch ..... E04H 15/324 52/2.19
4,932,169 A * 6/1990 Charbonneau ..... E04H 15/20 52/2.25
5,007,212 A * 4/1991 Fritts ..... E04H 15/20 52/2.18
5,107,881 A * 4/1992 Feldman ..... E04H 15/36 135/156
5,345,962 A * 9/1994 Moss ..... E04H 15/322 135/156
5,390,688 A * 2/1995 Lipman ..... E04H 15/18 135/97
5,394,897 A * 3/1995 Ritchey ..... E04H 15/18 52/79.8
5,479,743 A * 1/1996 Queen ..... E04H 15/20 52/2.22
5,487,400 A * 1/1996 Dawkins ..... E04H 15/324 135/124
5,502,927 A * 4/1996 Hammerton ..... E04H 15/324 52/2.13
5,544,671 A * 8/1996 Phillips ..... B60P 3/341 135/88.14
D383,188 S * 9/1997 Bohart ..... D21/838
6,167,898 B1 * 1/2001 Larga ..... E04H 15/20 135/124
6,192,633 B1 * 2/2001 Hilbert ..... E04H 15/20 52/87
6,192,909 B1 * 2/2001 Strausser ..... E04H 15/40 5/113
6,216,715 B1 * 4/2001 Howe ..... E04H 15/14 135/95
6,260,306 B1 * 7/2001 Swetish ..... E04H 15/20 135/96
6,263,617 B1 * 7/2001 Turcot ..... E04H 15/20 52/2.13
6,289,834 B1 * 9/2001 Phillips ..... B63J 2/04 454/82
6,397,869 B1 * 6/2002 Jennings ..... E04H 15/32 135/93
6,708,451 B1 * 3/2004 Gomes ..... E04H 15/20 52/2.25
6,722,084 B2 * 4/2004 Berman ..... E04H 15/006 135/96
7,134,443 B1 * 11/2006 Shires ..... E04H 15/36 135/117
7,146,996 B1 * 12/2006 Shires ..... E04H 15/36 135/117
7,604,016 B2 * 10/2009 Songest ..... E04H 6/04 135/132
8,079,182 B1 * 12/2011 Higgins ..... E04H 7/24 52/2.25
8,166,711 B2 * 5/2012 Lamke ..... E04H 15/20 52/2.13
8,499,500 B2 * 8/2013 Lamke ..... E04H 15/20 52/2.17
8,550,538 B1 * 10/2013 Brandenburg ..... B60P 3/341 5/118
D703,127 S * 4/2014 June ..... D12/317
9,869,110 B2 * 1/2018 Krenzel ..... E04H 15/50
10,233,665 B1 * 3/2019 Lee ..... E04H 15/32
10,704,287 B1 * 7/2020 Brown ..... A47C 27/082
10,801,231 B1 * 10/2020 Ensign ..... E04H 15/12
11,401,729 B2 * 8/2022 Cangemi ..... E04H 15/36
2001/0042563 A1 * 11/2001 Coupounas ..... E04H 15/36 135/117
2002/0083653 A1 * 7/2002 Hilbert ..... E04H 15/20 52/2.17
2007/0101466 A1 * 5/2007 Ferraro, Sr. ..... E04H 15/20 D21/835
2007/0295377 A1 * 12/2007 Holub ..... E04H 15/425 135/120.1
2008/0020695 A1 * 1/2008 Chang ..... B08B 15/026 55/385.2
2008/0313969 A1 * 12/2008 Colucci ..... G03B 21/585 52/2.18
2009/0025302 A1 * 1/2009 Wang ..... E04H 15/20 52/2.17
2009/0249700 A1 * 10/2009 Peterson ..... E04H 15/06 5/413 AM
2010/0083995 A1 * 4/2010 Sanders ..... E04H 15/324 5/413 AM
2011/0314747 A1 * 12/2011 Massey ..... A47C 19/12 135/96
2012/0125390 A1 * 5/2012 Damas ..... E04H 15/324 135/115
2012/0131857 A1 * 5/2012 Ross-da Silva ..... E04H 15/20 52/2.18

(56) References Cited

U.S. PATENT DOCUMENTS

| | | | | |
|---|---|---|---|---|
| 2012/0144756 | A1* | 6/2012 | Meager | A62C 2/10 52/2.22 |
| 2012/0260583 | A1* | 10/2012 | Bischoff | E04B 1/3211 52/81.1 |
| 2012/0304391 | A1* | 12/2012 | Driscoll, Jr. | F04D 17/161 5/710 |
| 2015/0034137 | A1* | 2/2015 | Tanaeim | E04H 15/54 29/428 |
| 2015/0315808 | A1* | 11/2015 | Cronk | E04H 15/322 135/121 |
| 2017/0089092 | A1* | 3/2017 | Krenzel | E04H 15/50 |
| 2017/0112267 | A1* | 4/2017 | Wu | E04H 15/40 |
| 2017/0234031 | A1* | 8/2017 | O'Sullivan | E04H 15/56 135/115 |
| 2019/0383054 | A1* | 12/2019 | Andre | E04H 15/18 |
| 2020/0240170 | A1* | 7/2020 | Timm | E04H 15/54 |
| 2021/0254363 | A1* | 8/2021 | Laetsch | E04H 15/20 |
| 2023/0212872 | A1* | 7/2023 | Lawson | E04H 15/56 52/2.18 |
| 2023/0407669 | A1* | 12/2023 | Eastwood | E04H 15/48 |

* cited by examiner

INFLATABLE SHELTER, KITS, METHODS, AND SYSTEMS

CROSS-REFERENCE TO RELATED APPLICATIONS

This application claims benefit under 35 U.S.C. 119(e) of U.S. Provisional Application No. 63/296,195, filed Jan. 4, 2022 the entirety of which is incorporated herein by reference.

FIELD OF THE INVENTION

This invention relates to an inflatable shelter with integrated mattress, powered inflation device, kits, methods, and systems used in providing shelter for people to camp within. It relates particularly to a shelter that deploys via inflation rapidly with the press of a single button due to the integrated air movement device running on an internal power supply.

BACKGROUND OF THE INVENTION

Campers are often wanting to pitch a tent quickly and without much hassle. Often, campers arrive at their destination for the night, and are tired and in need of rest. Campsites are often dark and lack easily accessible power for charging devices like cellular phones, gps devices, headlamps, speakers, or other such common modern camping accessories. Often campsites have little to no cover from rain and the elements, so the amount of time that it takes to set up a tent often is associated with how wet or uncomfortable a camper will be. Campers who are on an extended trip where they are setting up and taking down their tent multiple times over multiple days want a faster, simpler solution.

Most conventional tents are relatively complex to set up, as several coordinated assembly steps are required to create a comfortable, water-resistant shelter for the night. Rarely are tents error-proofed to prevent inadvertent assembly by way of orientation errors, or assembly-order mistakes. Tent poles can break or splinter and can even cause injury. Some tents have so much fabric that distinguishing where the poles and tent pegs need to insert can be a laborious, time-consuming task. Another issue with conventional tents is that depending on the type of mattress you have you can be at risk of having water ingress into the floor, feeling rocks or sticks or bumps on the ground. These mattresses require separate storage from the tent and require further operations like inflation in order to deploy them for use. A further problem with separate mattresses is that they prevent families or couples from experiencing the comfort of a shared bed. They also allow users the possibility of inadvertently slipping off the mattress onto the floor during the night.

Some campers choose to tow a trailer, use a rooftop tent, a truck bed mounted camper or even use a camper van to make the transition between driving and camping an easier task. Trailers can be difficult to tow with all vehicles and are complicated to both park and to maneuver into dark and tight camping spots. Roof top tents are expensive, reduce fuel economy, and require the user to have a compatible roof rack system. Campers for trucks are expensive, heavy, affect handling of the vehicle, and not accessible to those who drive cars. Campervans are expensive, often have poor off-road capabilities, and aren't convenient to owners who would like to only have a single vehicle. With all of these alternatives to tents the user is limited to camping in areas that have direct vehicle access, and they often need to be disassembled in order to move the vehicle.

Some inflatable tents exist, but they require a manual inflation device, or a traditional electric powered air pump that inflate slowly and aren't convenient to set up quickly in any desired location. Most commercially available inflatable tents are of poor quality, and do not employ robust materials or provide a shelter that is capable of resisting wind and/or snow loads.

Prior art shelters employing some sort of base/mattress and tent combinations in which at least one of these components is inflatable include those of U.S. Pat. No. 4,766,918 of Odekirk, U.S. Pat. No. 6,167,898 of Larga, U.S. Pat. No. 8,550,539 of Brandenberg, and U.S. Pat. No. 10,704,287 of Brown, U.S. Patent Application Publication 2010/0083995 of Sanders, and the commercially available SereneLife SLIENTAIR. Despite these prior endeavors, there remains room and need for improved and alternative solutions in the art.

SUMMARY OF THE INVENTION

According to One Aspect of the Invention, there is Provided an Inflatable Shelter Comprising:

- a base for seated placement atop a ground surface in a working position in which an outer perimeter of said base circumscribes a ground footprint of the shelter; and
- an inflationally erectable canopy attached to the base and comprising:
  - an inflatable rib structure comprising a plurality of inflatable ribs shaped and arranged to stand upward from the base when inflated; and
  - a plurality of wall panels coupled to and interspersed between said plurality of ribs to cooperate therewith, when inflated, to define said walled canopy in a manner covering the base and surrounding multiple sides thereof, thereby delimiting an interior tent space of the shelter;
- wherein the inflatable rib structure is configured such that a first subset of said inflatable ribs and wall panels cantilever outwardly beyond the ground footprint of the shelter when inflated to define an inflationally erectable overhang that provides overhead shelter to an expanded area beyond said ground footprint of the shelter.

According to another aspect of the invention, there is provided an inflatable shelter comprising:

- a base for seated placement atop a ground surface, said base comprising an inflatable mattress;
- an inflationally erectable canopy attached to the base and comprising:
  - an inflatable rib structure comprising a plurality of inflatable ribs of interconnected and fluidly communicated relationship to one another, and collectively shaped and arranged to stand upward from the base when inflated; and
  - a plurality of wall panels coupled to and interspersed between said plurality of ribs to cooperate therewith, when inflated, to define said walled canopy in a manner covering the base and surrounding multiple sides thereof, thereby delimiting an interior tent space of the shelter; and
- a powered inflation device shared by the inflatable mattress and the inflatable rib structure;
- wherein the powered inflation device feeds both an inflation port of the inflatable mattress, and an inflation port of the inflatable rib structure, and inflatable interiors of the inflatable ribs are fluidly isolated from one another to enable maintenance of different respective air pressures therein.

According to yet another aspect of the invention, there is provided an inflatable shelter comprising:

a base for seated placement atop a ground surface; and an inflationally erectable canopy attached to the base and comprising:

an inflatable rib structure comprising a plurality of inflatable ribs shaped and arranged to stand upward from the base when inflated; and a plurality of wall panels coupled to and interspersed between said plurality of ribs to cooperate therewith, when inflated, to define said walled canopy in a manner covering the base and surrounding multiple sides thereof, thereby delimiting an interior tent space of the shelter;

wherein the inflatable rib structure comprises a central rib running lengthwise of the inflatable shelter and arranged to reside elevationally above the base at a midplane of the shelter when inflated, and arching pairs of ribs arranged to, when inflated, arch over the base from opposing sides thereof and join with said central rib at spaced intervals therealong.

Preferred embodiments of this invention provide an inflatable shelter characterized by various combinations of a base mattress, a rib structure connected to wall panels, overhanging covered entrances, optional vestibules to attach to said covered entrances, an integrated power supply, charging station, ambient LED lights, and a powered air movement device, for example a button-actuated fan, as well as a carrying and storage means.

In preferred implementations, the shelter is easily deployed in the following manner. The user selects a camping location that can be remote from a vehicle or a location without power. They set the shelter down on the ground after removing it from the stowed/transport means, and they simply press the fan actuation button with the inflation/deflation selector switch set to inflate. This triggers the air movement device to rapidly, for example in less than twenty seconds, inflate the shelter by forcing air into the rib structure and mattress so that the wall sections are lifted, and the shelter is deployed. Once deployed, a user is easily able to enter the tent and has access to a charging station which could also power an integrated light system or other such electronic devices.

In one embodiment of the shelter, the user is also able to tune the firmness of the mattress by releasing air pressure from the mattress without affecting the pressure in the rib structure due to a chamber separation arrangement between the rib structure and the mattress to keep them fluidly isolated from one another, thereby enabling maintenance of different respective air pressures therein.

In another variant, the user can instead tune the firmness of the mattress by, during simultaneous inflation of both the mattress and rib structure from the shared inflation device, using a selector valve to terminate airflow to the mattress specifically once a desired mattress pressure is reached, while continuing to inflate the rib structure.

In one embodiment, the powered inflation device is an inflation/deflation device that is also operable to deflate the shelter When a user is ready to disassemble the tent and stow it for transport, the user switches an inflation/deflation selector switch to its deflate setting, then presses the fan actuation button, and the air is rapidly sucked out of the ribs and mattress by way of the air movement device, like a vacuum, in order to quickly deflate the shelter and minimize the packed volume of the tent.

Several Objects and Advantages of the Present Invention, at Least Partially Fulfilled in One Form or Another Among the Various Embodiments Disclosed Herein, Whether Claimed or Otherwise, Include:

a) To provide a shelter with an integrated mattress that's capable of being rapidly deployed or stowed without shore or vehicle power in an extremely simple manner.

b) To provide a comfortable and waterproof sleeping surface that isn't sensitive to roots, bumps, or irregularities on the ground.

c) To provide the ability to tune the firmness of the sleeping surface.

d) To provide a shelter with covered entrances that provide an overhang above the door of the shelter without requiring any special poles or guying with cords.

e) To provide charging capability and power for other items (lights, speakers, computers, etc.).

The above and other objects, features and advantages of the invention will become apparent from a consideration of the subsequent detailed description presented in connection with the accompanying drawings.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operational aspects may be even better understood by referencing the written portions together with the accompanying drawings, of which.

REFERENCE NUMERALS

Figure 1A:
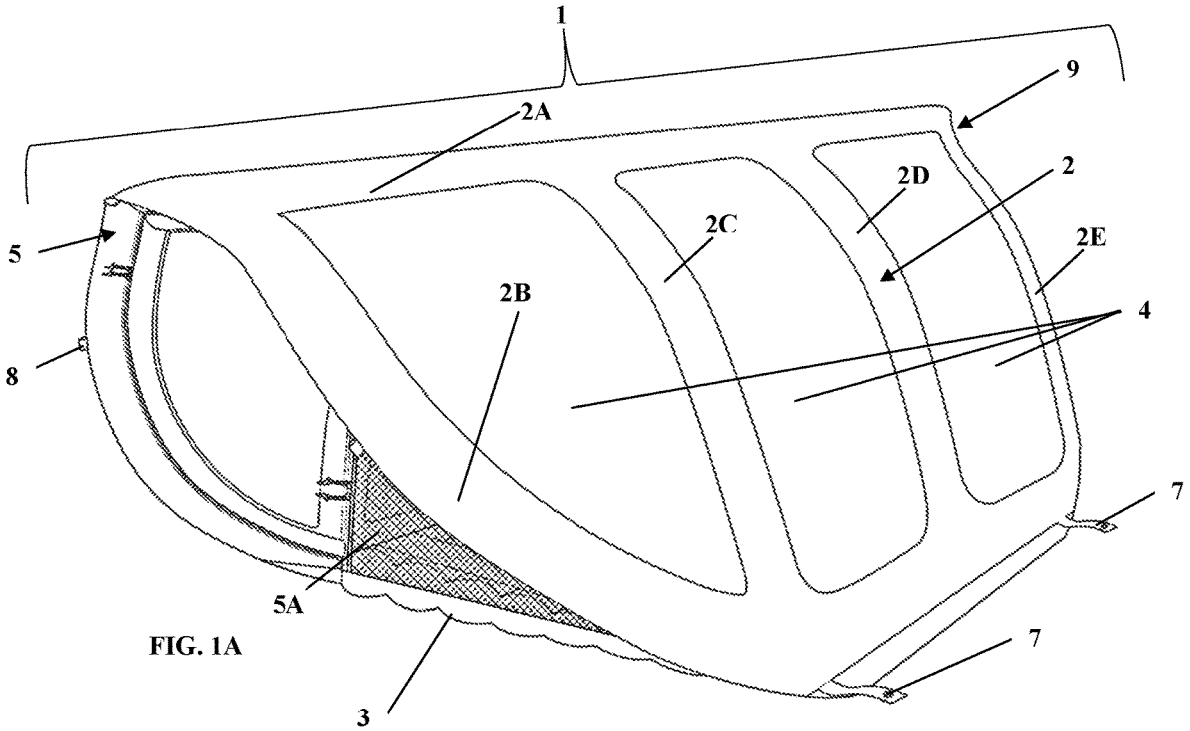
FIG. 1A is a perspective view of the deployed shelter which shows the covered entrance, as well as how the wall panels and ribs are supported above the mattress.

1 Shelter
2 Rib structure
2A-2E Inflatable Ribs
3 Mattress
4 Wall panel
5 Front entrance overhang
5A Front entrance panel
6 Vestibule component
7 Ground peg grommet
8 Guy line attachment
9 Rear entrance overhang
10 Powered inflation device
11 Fan actuation button
12 Inflation/Deflation selector switch
13 Air Intake port
14 Air supply port
15 Air movement device
16 Stowed configuration
17 Compression straps
18 Carrying means
19 Mattress tuning valve
19A Inflation selector valve 19A
20 Charging ports
21 Chamber separation means
22 Rib inflation port
23 Mattress inflation port
24 T-connection tube
25 Weld
26 Sewn seam
27 Electric motor
28 Controller
29 Electric power supply
30 Baffle
31 Motor output shaft

DETAILED DESCRIPTION OF PARTICULAR EMBODIMENTS OF THE INVENTION

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

With reference now to the drawings, and in particular to FIGS. 1A through 8B thereof, a new inflatable shelter with integral air mattress, inflation means, and power supply embodying the principles and concepts of the present invention and generally designated by the reference numeral 1 will be described.

Figure 1B:
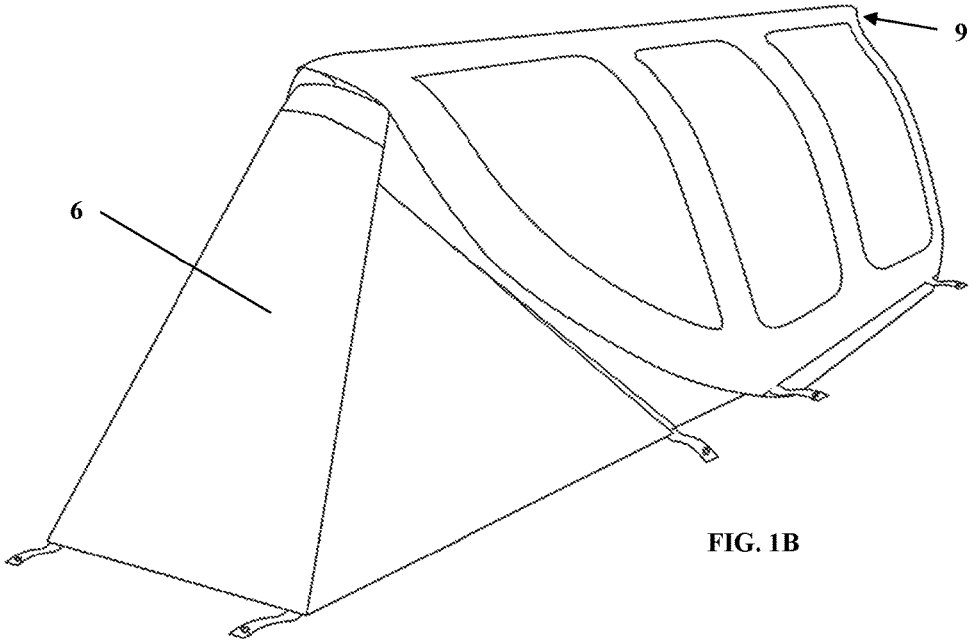
FIG. 1B is a perspective view of the deployed shelter which shows an optional vestibule component attached to a front overhang of the shelter in order to enclose a front entrance thereof.

As best illustrated in FIGS. 1A and 1B, the shelter 1 comprises a base 3 that is supported upon the ground and is embodied, at least in part, by an inflatable mattress; an inflatable rib structure 2 that, when inflated, extends upwardly from the base 3; and wall panel members 4 that are attached to and supported by the rib structure 2 in positions spanning the areas between the various inflatable ribs thereof.

The inflatable mattress embodies the entirety of the base 3 in the illustrated but non-limiting embodiment, and is best illustrated in FIGS. 1A, 2, 4, 5, and 7. The flexible envelope of the inflatable mattress 3, which delimits the inflatable interior thereof, is composed of a water-resistant material, such as TPU coated fabric, or the like. The mattress 3 rests directly upon the ground, and therefore it has a pre-selected thickness for cushioning and insulating properties. The underside of the mattress 3 thus defines a ground footprint of the shelter, i.e. the amount (surface area) of ground space occupied by the erected shelter. The inflatable rib structure 2 supports the wall panel members 4 to provide an elevated cover and sidewalls to the shelter, which collectively may be referred to as a canopy of the shelter. An interior space of the tent is therefore delimited between the topside of the mattress 3 and the inside/underside of the overlying canopy, when inflationally erected. Like the mattress 3, both the rib structure 2 and wall panels 4 are also constructed of water-resistant material, such as TPU coated fabric, or the like. In a preferred embodiment, the rib structure 2, mattress 3 and wall panels 4 are joined together by radio frequency (RF) welding, and in some instances, RF welding in combination with sewn seams.

The inflatable rib structure 2 is composed of a plurality of inflatable ribs, each composed of a flexible envelope of the aforementioned water-resistant material to delimit a respective inflatable interior of the rib. The inflatable interiors of the various ribs are fluidly communicated with one another where any two or more of the various ribs meet one another. The ribs include a lengthwise central rib 2A that, in the erected state of the canopy, runs longitudinally thereof in a lengthwise vertical midplane of the shelter. The lengthwise direction refers to a horizontal direction in which the illustrated shelter 1 is longer than it is in its horizontal width direction that lies perpendicularly transverse to the length. In the illustrated example, front and rear ends of the shelter 1 refer to perimeter segments thereof that are of distally spaced relation to one another in the lengthwise direction, while sides of the shelter refer to the two remaining perimeter segments thereof that span lengthwise between the front and rear ends of the shelter.

Aside from the lengthwise central rib 2A, a remainder of the ribs are arranged in arching pairs dispersed at lengthwise intervals between the front and rear ends of the shelter 1.

These arching pairs, listed in order from front-to-back, include a forwardly cantilevered arch pair 2B at the front end of the shelter 1, a non-cantilevered mid-front arch pair 2C, a non-cantilevered mid-rear arch pair 2D, and finally a rearwardly cantilevered arch pair 2E at the rear end of the shelter 1. Each arch pair features two half-arch ribs each having its bottom end attached to the mattress 3 at a respective one of the two sides thereof. The two half-arch ribs reside in symmetric relation to one another across the vertical midplane of the shelter where the lengthwise central rib 2A resides. The two half-arch ribs of each arch pair join with the lengthwise central rib 2A at opposing sides thereof, and the inflatable interiors of all three of these ribs are fluidly communicated with one another at this joined location. The two half-arch ribs in each of the two mid arch pairs 2C, 2D resides in a same vertical reference plane as one another, which reference plane is of orthogonal relationship to the vertical midplane occupied by the lengthwise central rib 2A, and also of orthogonal relationship to the horizontal plane of the mattress 3. These vertical reference planes denote a very upright orientation of these two mid pairs 2C, 2D of ribs, where neither mid pair has any notable forward or rearward incline in the lengthwise direction of the shelter.

Contrary to this, the forwardly and rearwardly cantilevered arch pairs 2B, 2E deviate from this purely upright orientation of the mid pairs 20, 2D, and instead each occupy a more inclined orientation in the lengthwise direction. In the illustrated example, the forwardly cantilevered pair 2A is the more inclined of the two cantilevered pairs 2B, 2E, as best shown in side view of FIG. 8. The two half-arch ribs of the forwardly cantilevered arch pair 2B are curved in two dimensions. The bottom of each half-arch rib of the forwardly cantilevered pair 2B emanates forwardly from the front end of the mattress 3 at a respective side thereof, and curves both upwardly therefrom, and laterally inward toward the vertical midplane of the shelter, where both half-arch ribs of the forwardly cantilevered pair 2B join up with the lengthwise central rib 2A at a forwardmost end thereof. The overall length of the lengthwise central rib 2A exceeds that of the mattress 3, and so the lengthwise central rib 2A and the two half-arch ribs of the forwardly cantilevered arch pair 2B all overhang from the front end of the mattress 3. The two half-ribs of the forwardly cantilevered arch pair 2B cantilever forwardly from the mattress 3 at the front end thereof, and support the overhanging portion of the lengthwise central rib 2A. The two wall panels 4 occupying the space between the forwardly cantilevered pair 2B of ribs and the mid-front pair 2B of ribs on opposite sides of the lengthwise central rib 2A thus cooperate with the lengthwise central and forwardly cantilevered ribs 2A, 2B to define a front overhang 5 of the shelter 1 that cantilevers outwardly beyond the shelter's footprint area at the front end thereof. This front overhang 5 provides overhead shelter to an expanded area beyond the ground footprint occupied by the underside of the mattress 3.

Figure 8A:
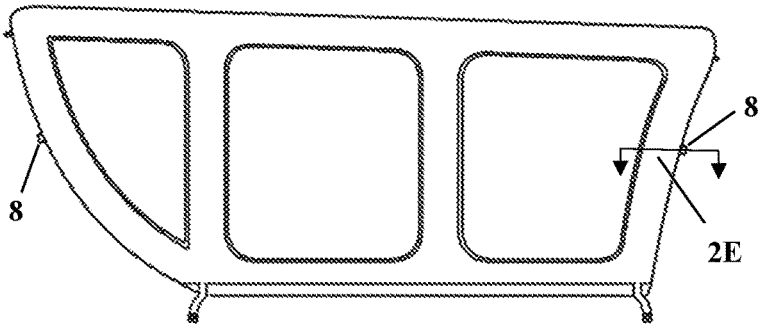
FIG. 8A is a side view of the shelter.

As best shown in the side view of FIG. 8A, the profile shape imparted to the canopy's front end by the forwardly cantilevered arch pair 2B is of convex curvature in side-profile. The ribs of the rearwardly cantilevered arch pair 2E are also inclined and curved in two dimensions like the ribs of the forwardly cantilevered arch pair 2B, thus again differing from the more upright mid pairs 2B, 2C whose ribs are curved in only one dimension. However, the rearward angulation of the rearwardly cantilevered arch pair 2E from a vertical reference plane is less than the forward angulation of the forwardly cantilevered arch pair 2B from such a vertical reference plane, as best seen in the side-profile of FIG. 8A. Here it can also be seen that the profile shape imparted to the canopy's rear end by the rearwardly cantilevered arch pair 2E is of concave curvature in side-profile, contrary to the convexly curved front end side profile. The rearwardly cantilevered pair 2E of ribs thus angle more aggressively upward from the rear end of the mattress 3 at the opposing sides thereof, but once again join up with the lengthwise central rib 2A at the shelter's lengthwise mid plane, this time at a rear end of the central rib 2A that is once again of overhanging relation from the respective end of the mattress, but less so than at the more greatly overhanging front end of the lengthwise central rib 2A.

As shown best in FIG. 1A, the front overhang 5 is accompanied by a zippered front entrance panel 5A that, in its closed state, closes off an otherwise open front entrance of the interior tent space that is located at the front end of the mattress 3, and beneath the erected mid-front arch pair 2B of the rib structure 2. In the illustrated example, this front entrance panel 5A is shown to be of a mesh construction, enabling ambient airflow into and out from the interior tent space, even in the closed position of the front entrance panel 5A. Via unzippering thereof, the front entrance panel 5A is selectively openable to enable entrance and exit to and from the interior tent space via the front entrance. In FIG. 1B, optional vestibule component 6 is shown connected to the front overhang 5 in a position hanging therefrom down to ground level to form vestibule walls around all three sides of the expanded overhang-covered area of the shelter, thereby extending the overall enclosed area of the shelter beyond the mattress-occupied interior tent space. This extended vestibule 6 provides dry coverage for cooking, footwear, baggage, etc. Optional vestibule component 6 could be permanently attached to the front overhang 5 and stored in a pocket defined thereon, or could be removable and attached with a zipper or other selectively engageable connection means. So as to enable entrance and exit to and from the interior tent space, even when the vestibule is deployed, the shelter also features a rear entrance, which may likewise be equipped with a zippered mesh entrance panel (not shown) at the rear end of the mattress 3 to allow entrance to, and exit from, the interior tent space at the rear of the shelter. At this rear entrance, the rearwardly cantilevered arch pair 2E of the rib structure 2 creates a rear-overhang 9 over the rear entrance, once again extending beyond the ground footprint of the mattress 3 to cover an expanded rear area, but to a lesser extent than the larger front overhang 5.

Mattress 3 can be fixedly attached to the ground by way of commonly known tent pegs that are inserted through ground peg grommets 7 which, in the illustrated embodiment, are directly attached to mattress member 3. In the inflationally erected context of the present invention, tent pegs are not essential to the achievement and maintenance of the shelter's erected state, like some tents, and when included, are provided only as an anchoring means for securement of the shelter to the ground. Further anchoring of the rib structure 2 for use in windy or high load scenarios such as winter camping can optionally be achieved by way of the illustrated guy line attachments 8. It should be noted that again this is optional anchoring, and such guy line attachments 8 need not necessarily be used or included, being that they are not required to establish or maintain an erected state of the shelter 1, which is instead achievable and maintainable solely through inflation of the inflatable rib structure 2.

Figure 2:
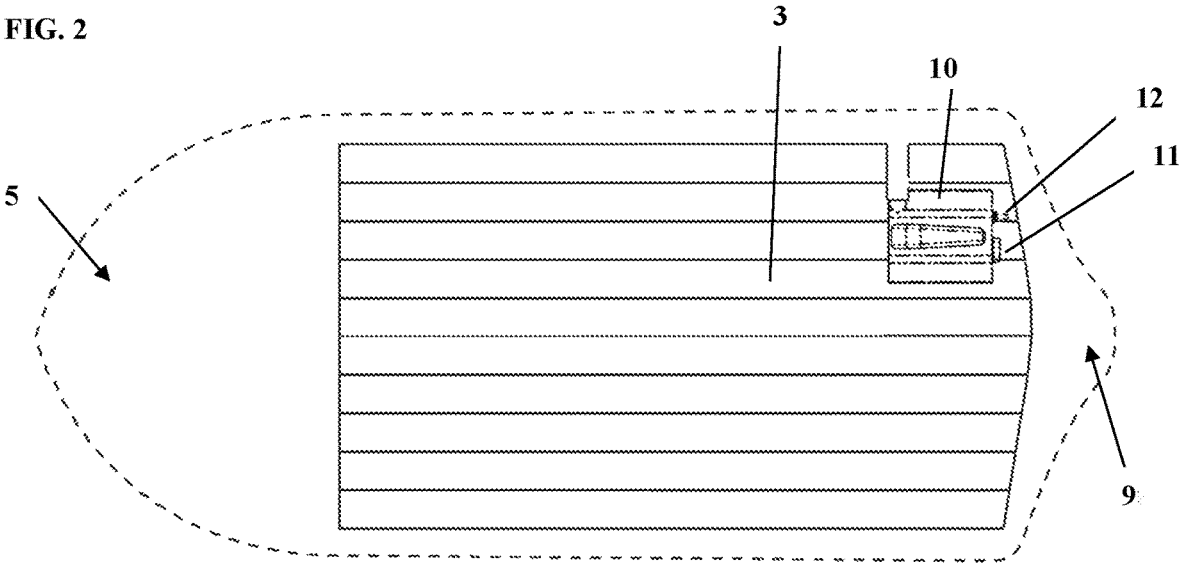
FIG. 2 is a plan view of the mattress and the powered inflation device, showing one possible placement thereof with its fan actuation button and inflation/deflation selector switch.

FIG. 2. illustrates where the powered inflation device 10 is located in the illustrated example, and also shows inclusion thereon of a fan actuation button 11, as well as an inflation/deflation selector switch 12 which controls a direction of air flow provided by an air movement device 15 of the powered inflation device 10. For brevity, the fan actuation button 11 and inflation/deflation selector switch 12 may be collectively referred to as simply fan controls. FIG. 2 shows how the powered inflation device 10 of the illustrated embodiment is located within the interior tent space of the shelter, i.e. atop the air mattress 10 and beneath the inflationally erectable canopy, and for example may optimally be located adjacent the rear entrance of the shelter. This way, a camper would access the fan controls 11, 12 from outside the interior tent space, by way of the overhang-covered rear entrance. Depending on whether the shelter is being erected from a deflated state, or deflated from an erected state, the camper would select either the inflation or deflation setting of the inflation/deflation selector switch 12, and lastly would press the fan actuation button 11. This way, the camper can either erect the shelter 1 quickly for use by selecting the inflation setting in order to operate the air movement device in an inflation mode conveying air into the mattress 3 and rib structure 2, or can collapse the shelter 10 quickly for stowage by selecting the deflation setting n order to operate the air movement device a deflation mode evacuating air from the mattress 3 and rib structure 2.

Figure 3A:
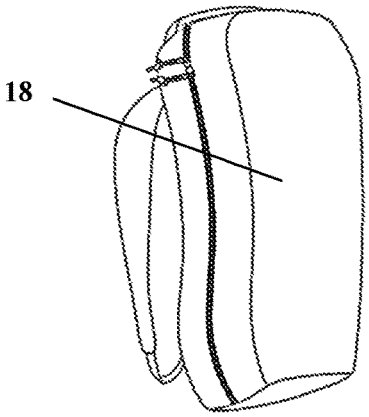
FIG. 3A is a perspective view of the shelter in a stowed/transport state contained within a carrying means.
Figure 3B:
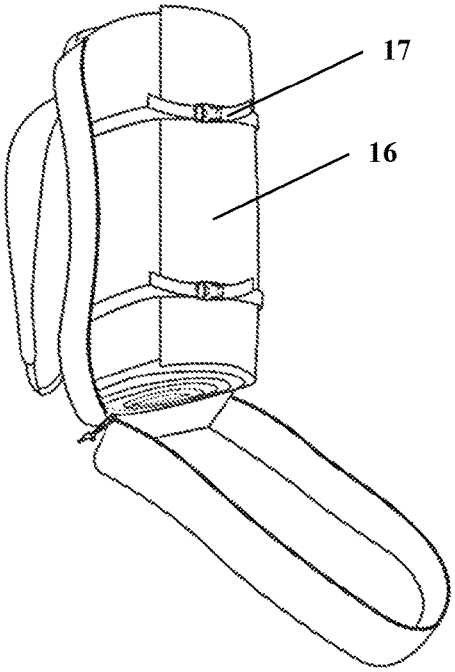
FIG. 3B is a perspective view of the shelter in the stowed/transport state showing how the shelter is housed inside the carrying means.

FIGS. 3A and 3B illustrate a stowed configuration 16 of the shelter 1, having been deflated and collapsed (e.g. rolled or folded), and also show how it can be transported easily by way of carrying means 18, such as a zippered backpack or duffle bag, drawstring sack, hard-shell case, etc. In the preferred embodiment, where the air movement device 15 is a dual mode device capable of operation in both inflation and deflation modes, use thereof in its deflation mode ensures that all the air is purged from the mattress 3 and rib structure 2, which minimizes the packed volume and bulk of the stowed shelter. As shown in FIG. 3B, compression straps 17 or other suitable binding ties may be bound around the collapsed shelter to further help achieve a minimum volume state of the shelter 1 when in the stowed configuration 16.

Figure 4:
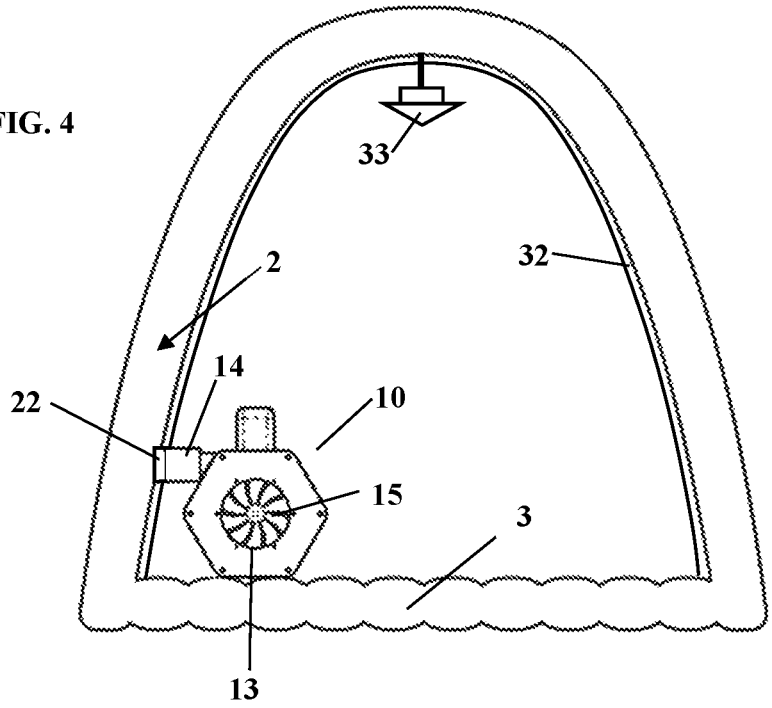
FIG. 4. is a front view of the shelter which schematically shows how the rib structure and mattress, in a first embodiment, are fluidly interconnected and have shared connection to the powered inflation device to allow inflation and deflation via one or more shared ports.

FIG. 4 schematically illustrates one possible setup of the functional inflation/deflation componentry of the shelter 1 according to a first embodiment thereof. In this instance, the mattress 3 and erected canopy are depicted in an elevational front view, with the zippered front entrance panel 5A removed to reveal a full view of the interior tent space. FIG. 4 illustrates that, within the powered inflation device 10, there is an air movement device 15 that, in the illustrated example, is embodied at least in part by a motor-driven fan rotor having a plurality of blades, and that when rotationally driven in a first (inflating) direction, draws in ambient air from the surrounding environment via an air intake port 13 and pushes the air onward through an air supply port 14 of the powered inflation device that feeds into either the rib structure 2 or the mattress 3, the inflatable interiors of which are fluidly communicated with one another in this particular embodiment, whereby feeding of air into either thereof inflates both the rib structure 2 and the mattress 3. In the illustrated example, the air supply port 14 of the fan feeds into the inflatable rib structure 2 via a rib inflation port 22 therein. So, in this first embodiment the rib structure 2 is not only physically connected to the mattress 3, but is fluidly connected thereto, whereby they function together as a single chamber that can be inflated or deflated simply by adding or removing air thereto via one or more shared ports, such as the illustrated rib inflation port 22. Manipulation of the inflation/deflation selector switch 12 to its deflation setting reverses the drive direction of the fan motor, such that depression of the fan actuation button will initiate driven rotation of the fan rotor in a second (deflation) direction of reverse relationship to the first (inflation) direction, so as to draw air into the fan through the air supply port 14 from the previously inflated rib structure 2 and mattress 3, and exhaust this evacuated air to the ambient environment through the air supply port 14.

The invention encompasses other forms of air movement devices for achieving the objectives of the invention, particularly that of fully inflating a shelter volume (which, in one non-limiting example, may be at least 400 liters or more) within a predetermined time period (which, in one non-limiting example, may be a maximum of 20 seconds, or less). For example, a ducted fan blower, a rotary or centrifugal fan/compressor, an axial fan/compressor (turbine), a rotary vane pump/blower/compressor, a gear pump, and a squirrel-cage blower/fan are non-limiting examples of possible air movement devices within the scope of the invention.

Further, in this regard, the fan/blower/compressor (i.e., generally referred to here as an "air movement device 15" or a part of such device) can be a single or a multi-stage configuration. To achieve higher pressures or a stronger draw of ambient air (if required based upon the application), multi-stage blowers in series, e.g., can be used (as with axial turbine compressors or two centrifugal vacuum cleaners). To achieve higher flow/fill rates or redundancy for safety, parallel systems can be used. A combination of two types of blowers also can be used (such as a rotary vane pump for high pressure for initial shelter deployment used with an axial ducted fan for very high-volume air movement).

Figure 5:
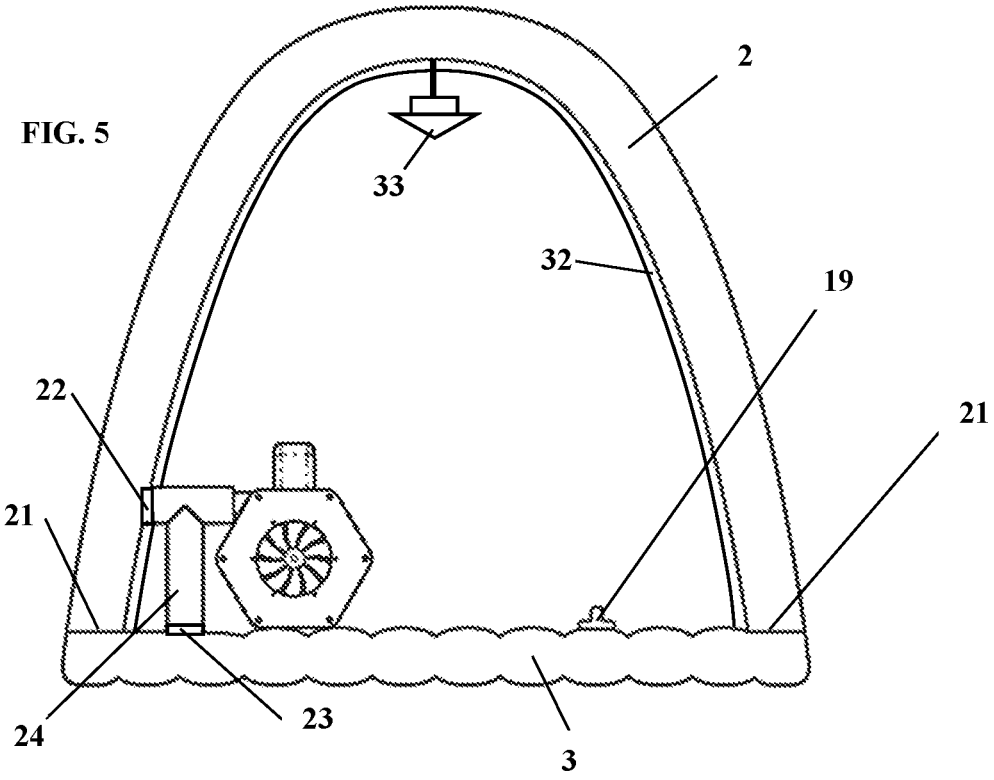
FIG. 5 is a front view of the shelter which schematically shows how the rib structure and mattress, in a second embodiment, are fluidly isolated and have separate respective connections to the powered inflation device. The mattress tuning valve is also shown, as are the respective inflation ports on the rib structure and the mattress.

FIG. 5 schematically illustrates another possible setup of the functional inflation/deflation componentry of the shelter 1 system according to a second embodiment thereof. Once again, the mattress 3 and erected canopy are depicted in an elevational front view, with the zippered front entrance panel 5A removed to reveal a full view of the interior tent space. FIG. 5 illustrates that, within the powered inflation device 10, there is again an air movement device 15 that, in the illustrated example, is embodied at least in part by a motor-driven fan rotor having a plurality of blades, and that when rotationally driven in a first (inflating) direction, draws in ambient air from the surrounding environment via an air intake port 13 and pushes the air onward through the air supply port 14 of the powered inflation device to again inflate both the rib structure 2 and the mattress 3. In this embodiment, instead of the air supply port 14 feeding a shared inflation port 22, the air supply port 14 instead feeds both a rib inflation port 22 of the rib structure 2 and a mattress inflation port 23 of the mattress 3, for example via a T-connection tube 24 or other style of multi-branch connector. In this second embodiment, the inflatable interior of the rib structure 2 is fluidly isolated from the inflatable interior of the mattress 3 by way of chamber separation means 21 present at any location where the rib structure 2 and mattress 3 are joined with one another. So, although the rib structure 2 and mattress 3 are still physically interconnected, like in the first embodiment, they are fluidly isolated from one another in the second embodiment in order to define two respectively distinct chambers. Accordingly, the chamber separation means 21 allows these two distinct chambers to be inflated and/or deflated separately, or at least somewhat independently of differently, of one another via their respective inflation ports 22, 23. After inflating both the rib structure 2 and mattress 3, a camper can then 'tune' the pressure of the mattress 3 by actuating a mattress tuning valve 19, for example by pressing a push-button actuator thereof to slowly release or bleed air pressure from only the respective chamber of the mattress 3 of FIG. 5, with effecting the air pressure in the separate chamber of the rib structure 2. It is in this way that different respective air pressures in the rib structure 2 and the mattress 3 can be achieved in this second embodiment, such that the camper can optimize the mattress pressure to achieve their desired firmness for optimal comfort. Deflation of the shelter 1 for stowage in this embodiment is again achieved by switching inflation/deflation selector switch 12 to the deflation setting, and then pressing the fan actuation button 11 to evacuate the air from both chambers via the T-connector tube 24. Being able to maintain the pressure in the rib structure 2 is important to the structural integrity of the canopy, and the novel tuning of the mattress independently of the rib structure's inflated air pressure retains such structural integrity, while also allowing a user to have a comfortable sleep on a mattress 3 that is selectively tuned to a user's particular comfort requirements/preferences by varying only the mattress's internal air pressure.

Figure 6A:
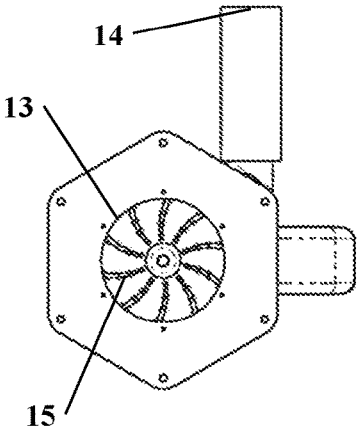
FIG. 6A is a front view of the powered inflation device.
Figure 6B:
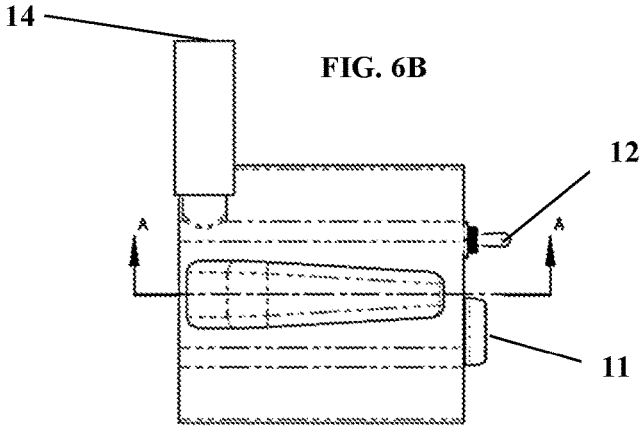
FIG. 6B is a top view of the powered inflation device.
Figure 6C:
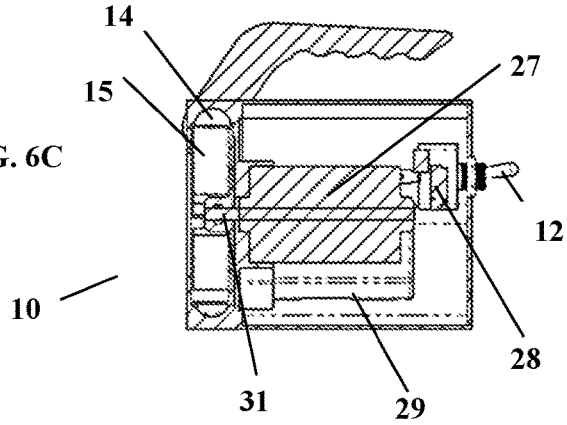
FIG. 6C is a cross sectional view of the powered inflation device showing the internal components, the air movement device, the batteries, the controller, and the electric motor.
Figure 6D:
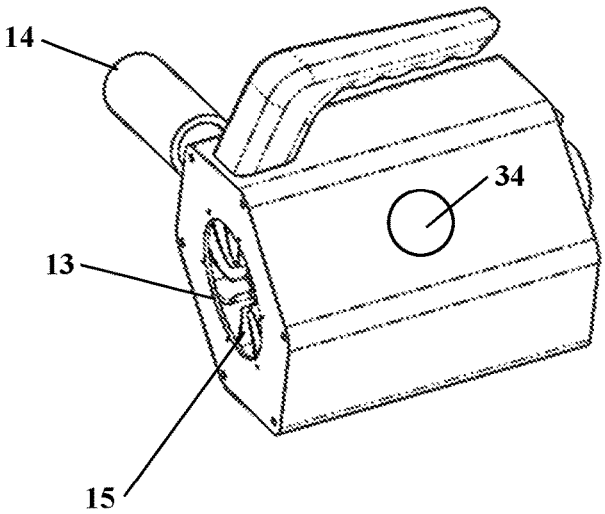
FIG. 6D is a perspective view of the powered inflation device.

FIG. 6C shows a cross section of the powered inflation device 10, and reveals that the air movement device 15 is driven by an electric motor 27, such as an inrunner or outrunner brushless DC motor. The air movement device 15 is positioned within a conduit proximate the air supply port 14 thereof, and is mounted on the output shaft 31 of the motor. In the illustrated embodiment, the motor 27 is positioned inline with the air movement device 15. The invention encompasses other types of electric motors, as well, which are suitable for achieving the objectives of the invention.

Figure 6E:
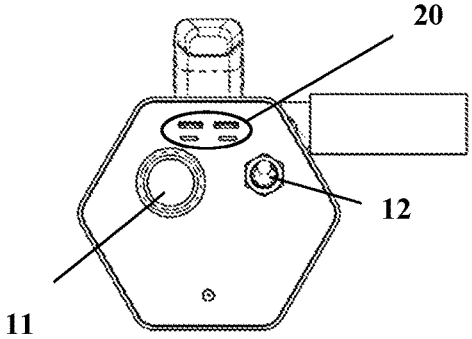
FIG. 6E is a rear view of the powered inflation device.

Also supported proximate to the electric motor 27 and air movement device 15, and wired to the motor, is the electric power supply 29, in the form of one or more, preferably rechargeable, batteries, such as of the lithium-polymer (LiPo) type, as well as an accompanying controller 28, such as that which provides digital control. FIG. 6E shows inclusion of one or more electrical charging ports 20 on the powered inflation device for optional charging of various electronic devices and camping accessories from the power supply 29, which ports may optionally reside proximate the fan actuation button 11 and the inflation/deflation selector switch 12, for example at one end wall of a housing of the powered inflation device whose opposing end wall may be characterized by inclusion of the air intake port 13. The electrical charging ports 20 are illustrated as USB charging ports, but are not limited to this style of port; they could be any type of direct current (DC) charging port, or even an alternating current (AC) port with the addition of an optional DC to AC inverter inside the powered inflation device 10.

Figure 7:
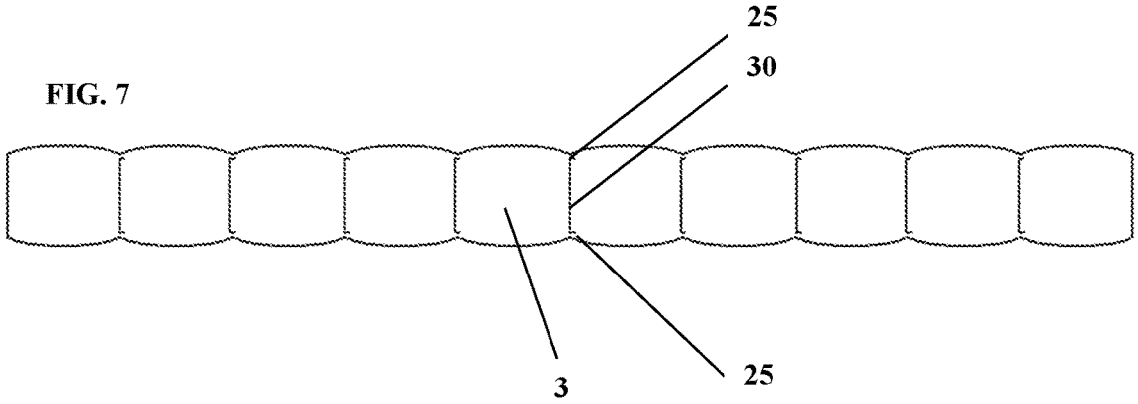
FIG. 7 is a cross section of the mattress which shows a welded construction thereof that includes internal baffles.
Figure 8B:
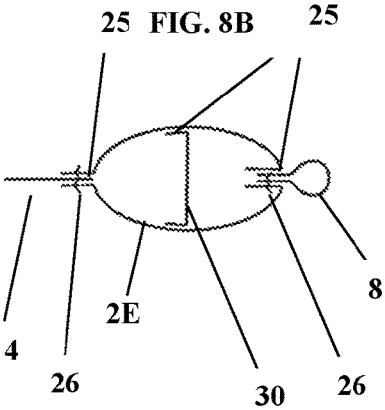
FIG. 8B is a cross sectional view of a rib showing its construction and how it's attached to a neighbouring wall panel and one or more guy line attachment points.

FIG. 7 shows a cross section of the mattress 3 to illustrate the aforementioned use of welds 25 in the construction of the mattress, as well as a plurality of internal baffles 30 contained within the inflatable interior of the mattress 3. These baffles 30 run parallel to one another in the lengthwise direction of the mattress at equally spaced intervals across the width dimension of the mattress 3, thus subdividing the inflatable interior of the mattress into a plurality of elongated sub-chambers. The baffles 30 are perforated to allow airflow from one sub-chamber to another. FIG. 8B shows a cross section taken of one of the rearwardly cantilevered ribs 2E of the rib structure 2 shown in FIG. 8A. Here, one can see the combination of a sewn seam 26 and a weld 25 along opposing inner and outer sides of the rib 2E in order to connect the rib structure 2 to a neighbouring wall panel 4 at the inner side of the rib 2E, and to a guy line attachment 8 at the opposing outer side of the rib 2E. The cross-section also illustrates the inclusion of internal baffles 30 inside the ribs, which like those of the mattress, are also perforated to allow complete inflation of the rib structure 2.

Figure 9:
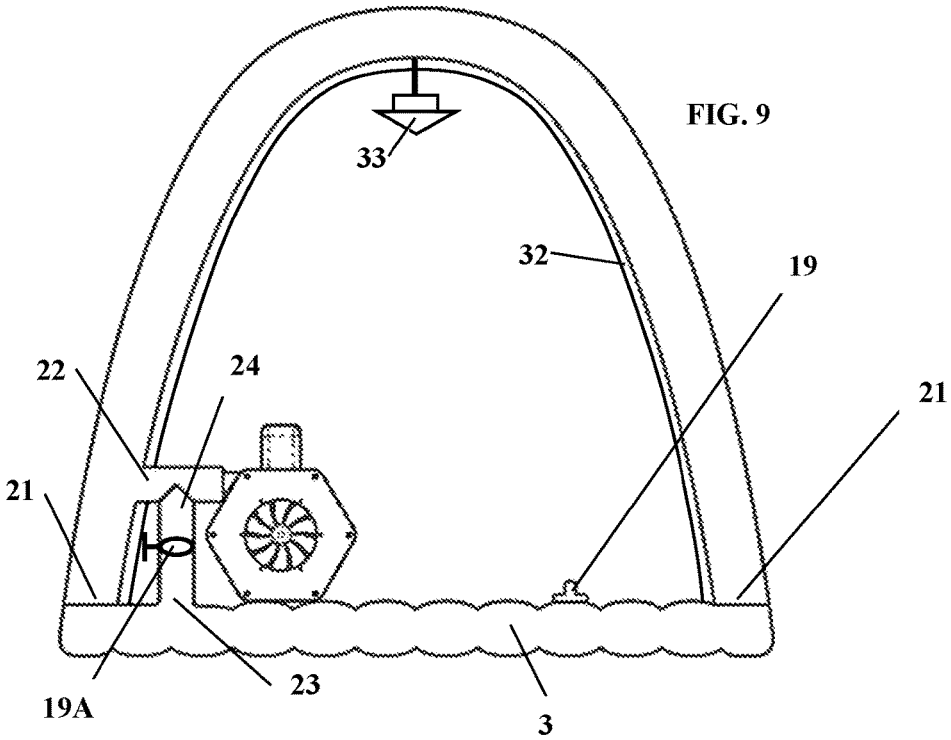
FIG. 9 is a front view similar to FIG. 5, showing a variant of the second embodiment that includes a selector valve for terminating inflation of the mattress before full inflation of the rib structure, as an alternative/additional means to set the mattress pressure according to a user-preferred firmness despite shared inflation of the mattress and rib structure from a common inflation source.

From the same vantagepoint as FIG. 5, FIG. 9 illustrates a variant of the second embodiment, in which the mattress tuning valve 19 is accompanied by, or may be omitted in favour of, an inflation selector valve 19A. This selector valve 19A is optionally actuable by a camper during simultaneous inflation of the rib structure and mattress via in order to terminate airflow to the mattress inflation port 23 via the down branch of the T-connector tube 24, yet maintain ongoing airflow to the rib structure inflation port 22 via the lateral branch of the T-connector tube 24. So, in this variant, instead of feeding air to both the rib structure and the mattress for the same period of inflation time, and then selectively bleeding off excess air pressure from the mattress 3 according to the user's mattress comfort preference, the user can instead terminate the mattress inflation process prematurely of the full rib inflation process by closing the selector valve 19A in the mattress-feeding down branch of the T-connector tube 24 to block airflow therethrough once the mattress has reached the desired firmness, without disrupting continued airflow to the rib structure for the remainder of the inflation process. As shown, the tuning valve 19 can optionally be retained as a supplemental mattress adjustment component on top of the inflation selector valve 19A that's operable to control whether airflow from the inflation device feeds one or both inflation ports 22, 23 at any given time during the inflation process. While the illustrated example places the selector valve 19A in the down branch of a T-connector tube 24, other tubing and valve arrangements for selective feeding of one or both inflation ports 22, 23 by the shared inflation device may alternatively be employed to similar effect. In both the FIG. 5 and FIG. 9 variants, the second embodiment minimizes the shelter setup time by simultaneously inflating both the rib structure and mattress, at least during part of the inflation process, while enabling user-selection of a preferred mattress pressure that is set or tuned independently of the fully inflated state of the rib structure.

FIGS. 4, 5 and 9 all illustrate inclusion of optional lighting features, which preferably employ light emitting diodes (LEDs) as their illuminating elements, which have relatively low power consumption, generate little heat, and consume direct current (DC), thereby allowing powering of such light sources via connection to the DC electrical supply 29 of the powered inflation device, for example via one or more of the electrical charging ports 20 thereof. The illustrated example includes one or more LED strip lights 32, for example chip-on-board (COB) LED strip lights, each respectively attached to the inside arch of any respective one of the arched rib pairs 2B, 2C, 2D, 2E to form a multi-directional light source emitting light inwardly from the canopy ceiling and walls. Attachment of such a strip light to the mid-front arch pair 2C and/or rearmost arch pair 2E may be particularly beneficial to illuminate the front and/or rear entrance of the shelter 1. As also shown, one or more lantern-style lights 33 can additionally or alternatively be disposed anywhere within the interior tent space, and optionally hung from the canopy ceiling, for example at the peak of any one of the arching rib pairs, as schematically illustrated. Each such light source is electrically connected to the powered inflation device, for example at one of the electrical charging ports 20 thereof, to draw power therefrom. The powered inflation device may also incorporate one or more on-board lights 34 thereon (e.g. FIG. 6D) that are directly wired to the internal electric power supply 29 thereof for direct powering of such on-board light 34 without taking up one of the electrical/ charging ports 20, which thus remain available for other uses (lighted related, or otherwise).

From the foregoing, the reader will appreciate that the shelter of the various embodiments and variants disclosed herein can easily be deployed rapidly to provide an insulated, waterproof, convenient and comfortable camping experience. The quick shelter deployment and stowing time allows what is usually a complicated chore that's difficult to do in low light or inclement weather to be easily achieved by most users even if they have no experience in setting up shelters for camping.

While the illustrated embodiment is one in which the base includes, and may be embodied entirely by, an inflatable mattress of integrated relation to the rest of the shelter, it will be appreciated that novel design aspects of the inflatable rib structure, such as the configuration thereof with cantilevered end ribs to create one or more overhangs that enlarge the covered area of the shelter beyond the covered base footprint, may be employed in shelter designs where the base is not characterized by an integrated air mattress, and may be embodied by a fabric base panel, atop which the user may optionally lay down a discretely separate air mattress. In other variants that do include an integrated air mattress, such air mattress need not necessarily define the entirety of the base, and may instead a partial, albeit typically a majority, fraction of the base's overall area, a remainder of which is occupied instead by a fabric base panel, which may also span across the underside of the mattress. The ground footprint may be defined partially or entirely by an inflatable air mattress, partially or entirely by a non-inflatable ground panel, or partially or entirely by a combination thereof.

In yet another embodiment, instead of an air mattress or fabric base panel, or combination thereof, whose underside defines a base-covered ground footprint of the shelter, the base may alternatively only occupy an outer margin of the shelter's ground footprint, leaving an exposed earthen floor that is circumscribed by that base-covered outer margin. In any event, regardless of whether the base is a full-coverage base occupying the entire ground footprint (e.g. an air mattress, fabric panel or combination thereof), or a marginal base occupying only an outer margin of the ground footprint in circumscribing relationship to an exposed earthen floor area contained within the overall ground footprint, it will be appreciated that the outer perimeter of the base circumscribes the overall footprint area of the shelter. Beyond this base-defined footprint area, additional overhead coverage for the camper's use is afforded in novel fashion by the one or more overhangs of the inflationally erected canopy and its one or more cantilevering rib pairs, the result of which is that the dimension of the shelter in at least one direction (the longitudinal direction in the illustrated example), is greater at the top end of the shelter than at the base (i.e. ground contacting bottom end) of the shelter.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

The invention claimed is:

1. An inflatable shelter comprising:

a base for seated placement atop a ground surface in a working position in which an outer perimeter of said base circumscribes a ground footprint of the inflatable shelter; and an inflationally erectable canopy attached to the base and comprising:

an inflatable rib structure comprising inflatable ribs shaped and arranged to stand upward from the base when inflated; and wall panels coupled to and interspersed between said inflatable ribs to cooperate therewith, when said inflatable ribs are inflated, to define said inflationally erectable canopy in a manner covering the base and surrounding multiple sides thereof to thereby shelter an interior tent space of the inflatable shelter;

wherein:

the inflatable rib structure is configured such that a cantilevered pair of said inflatable ribs, and an associated subset of the wall panels, cantilever outwardly beyond the ground footprint of the inflatable shelter when said inflatable ribs are inflated to define an inflationally erectable overhang that, at a front end of the inflationally erectable canopy, provides overhead shelter to an expanded area beyond said ground footprint of the inflatable shelter;

said cantilevered pair of the inflatable ribs are configured to, when inflated, cooperatively form a cantilevered arch of curved geometry in multiple dimensions, in which the cantilevered pair of the inflatable ribs emanate from a front end of the base at opposing sides thereof in directions that cantilever therefrom in a first outwardly convex curvature of forwardly, upwardly and outwardly convex arching orientation imparting an outwardly convex side profile to said front end of the inflationally erectable canopy, and that further possess a second outwardly convex curvature of laterally arching orientation that joins said cantilevered pair of the inflatable ribs together at a midplane of the inflatable shelter, among which both the first and second outwardly convex curvatures are characterized by outward convexity that faces outwardly away from the inflationally erectable overhang at outer extremities thereof; and a non-cantilevered pair of the inflatable ribs are configured to, when inflated, cooperatively form a non-cantilevered arch that arches laterally across the base at the front end thereof, and said non-cantilevered arch is accompanied by an openable/closeable entrance panel of the inflatable shelter that, in a closed state thereof, encloses the interior tent space of the inflatable shelter at the front end of the base and beneath the non-cantilevered arch, and thereby separates said interior tent space from the expanded area that is sheltered beneath the inflationally erectable overhang, yet resides outside said interior tent space.

2. The inflatable shelter of claim 1 wherein the base comprises an inflatable air mattress, and the cantilevered pair of the inflatable ribs emanate from the base at a front end of said air mattress.

3. The inflatable shelter of claim 1 wherein the inflatable ribs further comprise a central rib arranged to reside elevationally above the base at a midplane of the shelter, and run lengthwise thereof in a directionality corresponding to a longest dimension of the shelter, when inflated, and the cantilevered pair of the inflatable ribs join with said central rib at a terminal front end thereof.

4. The inflatable shelter of claim 3 wherein the central rib is arranged to, when inflated, occupy a sloped orientation characterized by a greater elevation at the terminal front end of the central rib that at an opposing terminal rear end thereof, and the inflatable ribs further comprise a rearmost pair of arching ribs that join with said central rib at the terminal rear end thereof.

5. The inflatable shelter of claim 3 wherein the inflatable ribs further comprise a rearmost pair of arching ribs that join with said central rib at an opposing terminal rear end thereof.

6. The inflatable shelter of claim 5 wherein the central rib is arranged to, when inflated, occupy a sloped orientation characterized by a greater elevation at the terminal front end of the central rib than at an opposing rear end thereof, and the inflatable ribs further comprise a rearmost pair of arching ribs that join with said central rib at the terminal rear end thereof.

7. An inflatable shelter comprising:

a base for seated placement atop a ground surface; and an inflationally erectable canopy attached to the base and comprising:

an inflatable rib structure comprising inflatable ribs shaped and arranged to stand upward from the base when inflated; and wall panels coupled to and interspersed between said inflatable ribs to cooperate therewith, when said inflatable ribs are inflated, to define said inflationally erectable canopy in a manner covering the base and surrounding multiple sides thereof to thereby shelter an interior tent space of the inflatable shelter;

wherein the inflatable ribs comprise a central rib arranged to reside elevationally above the base at a midplane of the shelter, and run lengthwise thereof in a directionality corresponding to a longest dimension of the shelter, when inflated, and arching pairs of ribs arranged to, when inflated, arch over the base from opposing sides thereof and join with said central rib at spaced intervals therealong, said arching pairs of ribs including:

a cantilevered pair of arching ribs that, when inflated, cantilever outwardly beyond the ground footprint of the inflatable shelter, in accompaniment by an associated subset of the wall panels, to define an inflationally erectable overhang that, at a front end of the inflationally erectable canopy, provides overhead shelter to an expanded area beyond said ground footprint of the inflatable shelter, said cantilevered pair of arching ribs joining with said central rib at a terminal front end thereof; and a non-cantilevered pair of arching ribs that, when inflated, cooperatively form a non-cantilevered arch spanning across the base at the front end thereof in a shared singular plane that lies transversely of the central rib and is shared by both arching ribs of said non-cantilevered pair, which join together at said central rib and are accompanied by an openable/closeable entrance panel of the inflatable shelter that, in a closed state thereof, encloses the interior tent space of the inflatable shelter at the front end of the base and beneath the non-cantilevered arch, and thereby separates said interior tent space from the expanded area that is sheltered beneath the inflationally erectable overhang, yet resides outside said interior tent space.

8. The inflatable shelter of claim 7 wherein the base comprises an inflatable air mattress, and the cantilevered pair of arching ribs emanate from the base at a front end of said air mattress.

9. The inflatable shelter of claim 7 wherein the central rib is arranged to, when inflated, occupy a sloped orientation characterized by a greater elevation at the terminal front end of the central rib than at an opposing terminal rear end thereof, where the inflatable ribs comprise a rearmost pair of arching ribs that join with said central rib.

10. An inflatable shelter comprising:

a base for seated placement atop a ground surface in a working position in which an outer perimeter of said base circumscribes a ground footprint of the inflatable shelter; and an inflationally erectable canopy attached to the base and comprising:

an inflatable rib structure comprising inflatable ribs shaped and arranged to stand upward from the base when inflated; and wall panels coupled to and interspersed between said inflatable ribs to cooperate therewith, when said inflatable ribs are inflated, to define said inflationally erectable canopy in a manner covering the base and surrounding multiple sides thereof to thereby shelter an interior tent space of the inflatable shelter;

wherein:

the inflatable rib structure is configured such that a cantilevered pair of said inflatable ribs, and an associated subset of said wall panels, cantilever outwardly beyond the ground footprint of the inflatable shelter when said inflatable ribs are inflated to define an inflationally erectable overhang that, at a front end of the inflationally erectable canopy, provides overhead shelter to an expanded area beyond said ground footprint of the inflatable shelter; and said cantilevered pair of the inflatable ribs are configured to, when inflated, cooperatively form a cantilevered arch of curved geometry in multiple dimensions, in which the cantilevered pair of the inflatable ribs emanate from a front end of the base at opposing sides thereof in directions that cantilever therefrom in a first outwardly convex curvature of forwardly, upwardly and outwardly convex arching orientation imparting an outwardly convex side profile to said front end of the inflationally erectable canopy, and that further possess a second outwardly convex curvature of laterally arching orientation that joins said cantilevered pair of the inflatable ribs together at a midplane of the inflatable shelter, among which both the first and second outwardly convex curvatures are characterized by outward convexity that faces outwardly away from the inflationally erectable overhang at outer extremities thereof.

11. The inflatable shelter of claim 10 wherein the base comprises an inflatable air mattress, and the cantilevered pair of the inflatable ribs emanate from the base at a front end of said air mattress.

12. The inflatable shelter of claim 10 wherein the inflatable ribs further comprise a central rib arranged to reside elevationally above the base at a midplane of the shelter, and run lengthwise thereof in a directionality corresponding to a longest dimension of the shelter, when inflated, and the cantilevered pair of the inflatable ribs join with said central rib at a terminal front end thereof.

13. The inflatable shelter of claim 12 wherein the inflatable ribs further comprise a rearmost pair of arching ribs that join with said central rib at an opposing terminal rear end thereof.

* * * * *